US010246993B2

(12) United States Patent
Melsheimer

(10) Patent No.: US 10,246,993 B2
(45) **Date of Patent: *Apr. 2, 2019**

(54) DIRECT PULLBACK DEVICES AND METHOD OF HORIZONTAL DRILLING

(71) Applicant: MELFRED BORZALL, INC., Santa Maria, CA (US)

(72) Inventor: Eric Melsheimer, Santa Maria, CA (US)

(73) Assignee: Melfred Borzall, Inc., Santa Maria, CA (US)

( * ) Notice: Subject to any disclaimer, the term of this patent is extended or adjusted under 35 U.S.C. 154(b) by 69 days.

This patent is subject to a terminal disclaimer.

(21) Appl. No.: 15/623,145

(22) Filed: Jun. 14, 2017

(65) Prior Publication Data

US 2017/0284192 A1 Oct. 5, 2017

Related U.S. Application Data

(63) Continuation of application No. 14/181,545, filed on Feb. 14, 2014, now Pat. No. 9,719,344.

(51) Int. Cl.
*E21B 47/12* (2012.01)
*E21B 10/60* (2006.01)
(Continued)

(52) U.S. Cl.
CPC ..... *E21B 47/122* (2013.01); *E21B 7/046* (2013.01); *E21B 7/20* (2013.01); *E21B 7/28* (2013.01);
(Continued)

(58) Field of Classification Search
CPC ..... E21B 7/046
See application file for complete search history.

(56) References Cited

U.S. PATENT DOCUMENTS 4,531,592 A * 7/1985 Hayatdavoudi ..... E21B 10/18 175/340
5,176,211 A 1/1993 Halderman
(Continued)

OTHER PUBLICATIONS

Melsheimer; U.S. Appl. No. 14/181,545, filed Feb. 14, 2014.
(Continued)

*Primary Examiner* — David J Bagnell
*Assistant Examiner* — Manuel C Portocarrero
(74) *Attorney, Agent, or Firm* — Fitch, Even, Tabin & Flannery LLP

(57) ABSTRACT

An apparatus for horizontal directional drilling includes a housing and a sonde transmitter mounted in the housing. The housing includes a main fluid channel to permit a flow of a fluid therethrough. The apparatus further includes a fluid outlet at the front of the housing in communication with the main fluid channel and adapted to emit fluid from the front of the housing during pilot bore operations. The housing further includes a plurality of fluid ports in fluid communication with the main fluid channel and adapted to emit fluid from the housing during pullback operations. Drill bits, drill bit adapters, swivel connectors, and tow heads adapted to be coupled to the drill bits for direct pullback operations, as well as methods of direct pullback operations during horizontal direction drilling are also provided.

20 Claims, 13 Drawing Sheets

(51) Int. Cl.

| | |
|---|---|
| ***E21B 7/04*** | (2006.01) |
| ***E21B 7/20*** | (2006.01) |
| ***E21B 7/28*** | (2006.01) |
| ***E21B 17/05*** | (2006.01) |
| ***E21B 10/633*** | (2006.01) |

(52) U.S. Cl.
CPC ..... *E21B 10/602* (2013.01); *E21B 10/633* (2013.01); *E21B 17/05* (2013.01)

(56) References Cited

U.S. PATENT DOCUMENTS

| | | | | |
|---|---|---|---|---|
| 5,456,552 | A | 10/1995 | Cherrington | |
| 5,931,240 | A * | 8/1999 | Cox | E21B 7/06 175/398 |
| 6,209,660 | B1 | 4/2001 | Cox | |
| 6,250,403 | B1 | 6/2001 | Beckwith | |
| 6,250,404 | B1 | 6/2001 | Gunsaulis | |
| 6,260,634 | B1 | 7/2001 | Wentworth | |
| 6,470,979 | B1 | 10/2002 | Wentworth | |
| 6,644,421 | B1 | 11/2003 | Long | |
| 7,147,065 | B2 * | 12/2006 | Tjader | E21B 7/064 175/57 |
| 7,243,737 | B2 | 7/2007 | Michael | |
| 8,122,979 | B1 * | 2/2012 | Wright, Jr. | E21B 10/62 175/398 |
| 8,225,885 | B2 | 7/2012 | Wentworth | |
| 8,365,841 | B2 | 2/2013 | Dimitroff | |
| 2001/0017222 | A1 | 8/2001 | Wentworth | |
| 2002/0112890 | A1 * | 8/2002 | Wentworth | F16L 55/18 175/57 |
| 2005/0056463 | A1 * | 3/2005 | Aronstam | E21B 7/062 175/61 |
| 2009/0095532 | A1 * | 4/2009 | Laird | E21B 7/28 175/57 |
| 2009/0272578 | A1 * | 11/2009 | MacDonald | C10G 21/22 175/26 |
| 2010/0044102 | A1 * | 2/2010 | Rinzler | E21B 7/14 175/15 |
| 2012/0118640 | A1 * | 5/2012 | Runquist | E21B 7/046 175/57 |
| 2012/0152621 | A1 | 6/2012 | Wright | |
| 2013/0168154 | A1 * | 7/2013 | Webb | E21B 7/046 175/325.5 |

OTHER PUBLICATIONS

Schlumberger Oilfield Glossary entries for "bit nozzle" and "drillpipe"; accessed via www.glossary.oilfield.slb.com (Notice of References Cited by USPTO Nov. 29, 2016).

Schlumberger Oilfield Glossary entry for "drill pipe" accessed Feb. 15, 2017 via http://www.glossary.oilfield.slb.com/Terms/d/drill_pipe.aspx (Notices of References Cited by USPTO Feb. 17, 2017).

USPTO; Advisory Action issued in U.S. Appl. No. 14/181,545 dated Feb. 17, 2017.

USPTO; Final office action issued in U.S. Appl. No. 14/181,545 dated Nov. 29, 2016.

USPTO; Non-final office action issued in U.S. Appl. No. 14/181,545 dated May 25, 2016.

USPTO; Notice of Allowance issued in U.S. Appl. No. 14/181,545 dated Mar. 31, 2017.

Melsheimer; U.S. Appl. No. 15/904,158, filed Feb. 23, 2018.

* cited by examiner

FIG. 1
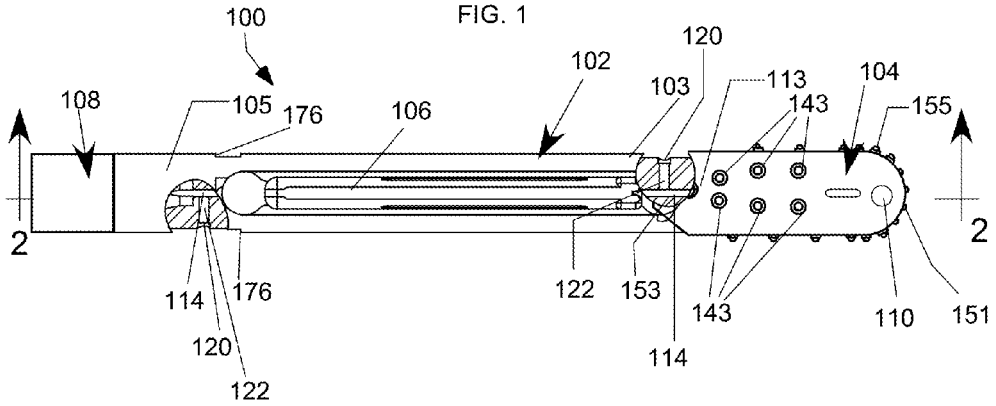
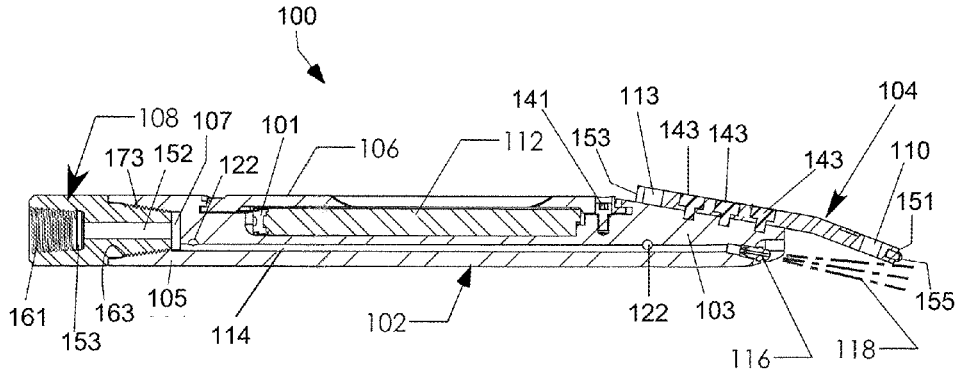
FIG. 2

DIRECT PULLBACK DEVICES AND METHOD OF HORIZONTAL DRILLING

This application is a continuation of U.S. application Ser. No. 14/181,545, filed Feb. 14, 2014, for DIRECT PULLBACK DEVICES AND METHOD OF HORIZONTAL DRILLING, which is incorporated in its entirety herein by reference.

FIELD

Devices and methods for use in underground drilling are described, and in particular, devices and methods for pilot bore and direct pullback operations in horizontal directional drilling.

BACKGROUND

Horizontal Directional Drilling (HDD) is a construction method alternative to open trenching that is used for installing conduits such as cables, pipes, and the like for underground utilities. In many HDD projects, a "pilot bore" is first made using a steerable drilling tool, typically consisting of a sonde housing, which may contain tracking electronics, a thread adapter and some type of drill bit. The drill bit is typically either a flat "paddle bit" or an "offset rock bit." This combination of sonde housing, thread adapter and drill bit may be referred to as the "drill head assembly." Typically, the thread adapter of the drill head assembly is connected to a string of drill rods. The drill rods may be 10'-15' in length and hollow with threaded ends. During pilot bore operations, the drill rods may be added to the drill string, one at a time, as the pilot bore proceeds further. The drill string may rotate to cut the soil and drilling fluid may be pumped through the drill rod and into the drill head assembly.

Typically, high pressure drilling fluid is pumped from the front of the housing or bit, in the general direction of the bore path, to aid in cutting the soil and steering. For most HDD projects, at the termination of the pilot bore, the drill head assembly is removed and a backreamer is attached. In one or more steps, the backreamer enlarges the hole to a size adequate for the pipe or conduit being installed, and drilling fluid is pumped through the backreamer to aid in the cutting of the soil, to condition the bore hole, and to provide a medium for carrying the cuttings out of the hole. The drilling fluid is typically pumped at a lower pressure and higher flow rate during backreaming than during the pilot bore drilling step. The product pipe is pulled into the reamed hole, behind the backreamer, in the "backream and pullback" step.

For installation of smaller utilities, such as telecommunication transmission lines or small gas distribution lines, the hole created by the pilot bore drilling step may be sufficiently large for the installed product pipe, without use of a backreamer. This simplifies the installation process by eliminating the need for removing the drill head assembly and attaching the backreamer. The product pipe can be attached to the drill head assembly by means such as shackles or swivels which attach to the drill bit. This is referred to as "direct pullback." It can be an effective method for installing smaller product pipes over shorter distances.

U.S. Publication No. 2002/0112890 and U.S. Pat. No. 8,122,979 describe some of the known drill bit designs including features designed for direct pullback. These documents are primarily directed to the attachment of the product pipe to the drill head assembly for direct pullback. However, current sonde housings and drill bits are not optimized for direct pullback. The drilling fluid is still pumped from the front of the sonde housing assembly, at high pressure and low flow rate. This is disadvantageous because the hole may be relatively dry in the backreaming direction, resulting in possible difficulties pulling back the product pipe, potentially damaging it or causing the direct pullback operation to be unsuccessful. As a result, typically, only small product pipes can successfully be installed.

In addition, if the drill head assembly rotates in a relatively dry hole, friction may cause the sonde housing to become heated, potentially damaging the tracking electronics housed inside. Also, the high pressure drilling fluid jet may impinge upon the swivel, puller or product pipe, also potentially causing damage. The flow rate of drilling fluid may also be lower than desired for installation of the product pipe. Typically the drill head assembly will not ream the hole larger than it was cut during the pilot boring operation, nor will it effectively mix the soil cuttings with the drilling fluid. This further limits the diameters and lengths of the product pipe that can be installed. It would be advantageous to be able to use direct pullback for larger or multiple product pipes.

Accordingly, what is needed is a direct pullback device and method that overcome the aforementioned disadvantages associated with the known devices.

SUMMARY

The present invention satisfies such a need. In one embodiment, an apparatus for horizontal directional drilling includes an elongated housing including an interior, a front, a rear, and a longitudinal axis passing through the front and rear. The apparatus further includes a sonde transmitter mounted in the interior. A main fluid channel extends in the interior of the housing in a direction along the longitudinal axis to permit a flow of a fluid therethrough. The apparatus may include a fluid outlet proximate the front of the housing and in fluid communication with the channel and adapted to permit the fluid to flow therethrough to facilitate pilot bore drilling operations. The apparatus further includes a plurality of fluid ports in fluid communication with the main fluid channel and adapted to permit the fluid to be emitted therethrough to facilitate pullback operations. The apparatus further includes a drill bit coupled to the front of the housing, the drill bit including a plurality of drill bit cutting elements.

The apparatus may include a plurality of plugs, each one of the plugs being inserted into a respective one of the fluid ports to prevent the fluid that flows through the channel from being emitted from the housing through the fluid ports. At least one of the plugs may include an opening to permit the fluid to flow through the at least one of the plugs when the at least one of the plugs is inserted into the respective one of the fluid ports.

The apparatus may further include a connecting member coupled to the drill bit. The connecting member may be coupled to a tow head sized and shaped to receive a portion of a conduit and retain the portion of the conduit during a direct pullback operation of the apparatus. The connecting member may be coupled to the drill bit indirectly, via a connecting link including an aperture for receiving a fastener.

In one embodiment, the drill bit is attached directly to the front of the housing. The drill bit may be one of a paddle bit and an offset rock bit. The offset rock bit may include a fluid outlet in a form of a nozzle to permit the fluid to be emitted from the nozzle to irrigate soil surrounding the nozzle.

The drill bit may be coupled to a bit body that includes an adapter configured to couple to the front of the housing and having a fluid channel passing therethrough and terminating in an opening adapted to permit the fluid that flows through the main fluid channel of the housing to be emitted from the opening of the bit body.

In one embodiment, the apparatus includes at least one cutting block removably coupled to the housing. The at least one cutting block element includes a plurality of cutting block cutting elements extending therefrom. In one approach, the apparatus may include at least a first cutting block removably coupled to the housing and including first cutting block cutting elements defining a first outer diameter extending therefrom, and at least a second cutting block removably coupled to the housing and including second cutting block cutting elements defining a second outer diameter extending therefrom, the second outer diameter being greater than the first outer diameter. The apparatus may further include a pullback adapter mounted on the drill bit, the pullback adapter including at least one cutting element extending therefrom and having at least one opening to permit a connecting member adapted to be coupled to a tow head to be coupled to the pullback adapter.

In one embodiment, the apparatus may further include a rear adapter coupled to the rear of the housing. The rear adapter is configured to permit a fluid source to be coupled to the housing and includes a fluid passage extending in a direction along the longitudinal axis and in communication with the main water channel in the housing. In one embodiment, at least a portion of the rear adapter is received in the rear of the housing when the rear adapter is threadably coupled to the housing. The rear adapter may include a fluid channel passing therethrough, the fluid channel being in fluid communication with the main fluid channel of the housing when the rear adapter is coupled to the housing. The rear adapter may also include at least one fluid port in fluid communication with the fluid channel of the rear adapter and adapted to permit the fluid to be emitted through the at least one fluid port of the rear adapter.

In one embodiment, a pullback adapter for attachment to a horizontal drilling apparatus includes a body including an opening for permitting a fastener to pass therethrough and first and second arms extending from the body. The first and second arms may include at least one cutting element extending therefrom adapted to cut through soil and opposed interior flat portions adapted to permit the first and second arms of the pullback adapter to slide over corresponding flat portions of the horizontal drilling apparatus. At least one of the first and second arms including at least one aperture adapted to permit a fastener to pass therethrough to attach the pullback adapter to the horizontal drilling apparatus. The at least one aperture of the pullback adapter may be positioned between two adjacent cutting elements.

In one embodiment, a cutting block for attachment to a horizontal drilling apparatus is provided. The cutting block includes a body including at least one cutting element extending therefrom and adapted to cut through soil. The cutting block further includes first and second arms extending from the body. The first and second arms include opposed interior flat portions adapted to permit the first and second arms of the cutting block to slide over corresponding flat portions of a housing of the horizontal drilling apparatus. At least one of the first and second arms may include at least one aperture adapted to permit a fastener to pass therethrough to attach the cutting block to the housing of the horizontal drilling apparatus. The at least one cutting element of the cutting block may include a plurality of cutting elements that are incrementally increased in size.

In an alternative embodiment, an apparatus for direct pullback during horizontal directional drilling includes: an elongated housing including an interior, a front, a rear, and a longitudinal axis passing through the front and rear; a sonde transmitter mounted in the interior;

a main fluid channel to permit a flow of a fluid therethrough, the channel extending in the interior of the housing in a direction along the longitudinal axis; a fluid outlet at the front of the housing, the fluid outlet being in fluid communication with the channel and adapted to permit the fluid to flow therethrough such that the fluid is emitted from the front of the housing; a plurality of fluid ports in fluid communication with the main fluid channel and adapted to permit the fluid to be emitted from the housing through the fluid ports, at least one of the fluid ports being at least in part obstructed by a removable fluid plug; a rear adapter coupled to the rear of the housing, the rear adapter configured to permit a fluid source to be coupled to the housing, the rear adapter including a fluid passage extending in a direction along the longitudinal axis and in communication with the main water channel in the housing; a drill bit coupled to the front of the housing, the drill bit including a plurality of drill bit cutting elements; a connecting member indirectly coupled to the drill bit via one of a connecting link and a pullback adapter such that the connecting member is securely attached to the drill bit with a central longitudinal axis of the connecting member being generally aligned with a central longitudinal axis of the housing; and a tow head coupled to the connecting member such that the tow head is permitted to swivel relative to the connecting member, the tow head being sized and shaped to receive a portion of a conduit and retain the portion of the conduit during a direct pullback operation of the apparatus.

In one preferred embodiment, a method of horizontal directional drilling includes: advancing, through a soil in a first direction, an elongated housing including a drill bit with a plurality of drill bit cutting elements and a nozzle at a front of the housing adapted to emit a fluid proximate the front of the housing to wet the soil and an at least one fluid outlet along a length of the housing adapted to emit the fluid along the length of the housing, the at least one fluid outlet being obstructed by a removable fluid plug; attaching a connecting member to indirectly to the drill bit via one of a connecting link and a pullback adapter, the one of the connecting link and the pullback adapter being securely fastened to the drill bit; attaching a tow head to the connecting member such that the tow head, when attached, is permitted to swivel relative to the connecting member; coupling a conduit to the tow head; attaching at least one cutting block to the housing; removing the fluid plug from the at least one fluid outlet; pulling the housing in a direction opposite to the first direction; and emitting, during the pulling of the housing in a direction opposite to the first direction, one or more jets of fluid from the at least one fluid outlet.

The drill head assemblies described therein provide numerous advantages over the presently used systems and methods. One advantage is that the drill head assemblies described herein advantageously lubricate the soil around the housing during direct pullback operations. Another advantage is that embodiments of the drill head assemblies described herein are configured to drill a hole of one diameter during the pilot bore drilling operation and to drill a hole of a larger diameter when passing through the same location during the direct pullback operation. Yet another advantage is that the fluid flow around the housing of the drill head assembly provides a cooling effect to the housing and to the transmitter installed in the housing, thereby protecting the transmitter from being overheated during the direct pullback operations. Further advantages will be appreciated by those of ordinary skill in the art with reference to the following drawings, detailed description, and claims.

BRIEF DESCRIPTION OF THE DRAWINGS

FIG. 1 is a top plan view of one embodiment of a drill head assembly for HDD drilling, configured for pilot boring with a paddle bit, shown in partial cross-section to show some of the internal structural elements of a housing of the drill head assembly;

FIG. 2 is a side elevational section view taken along line 2-2 of FIG. 1;

DETAILED DESCRIPTION

Figure 3:
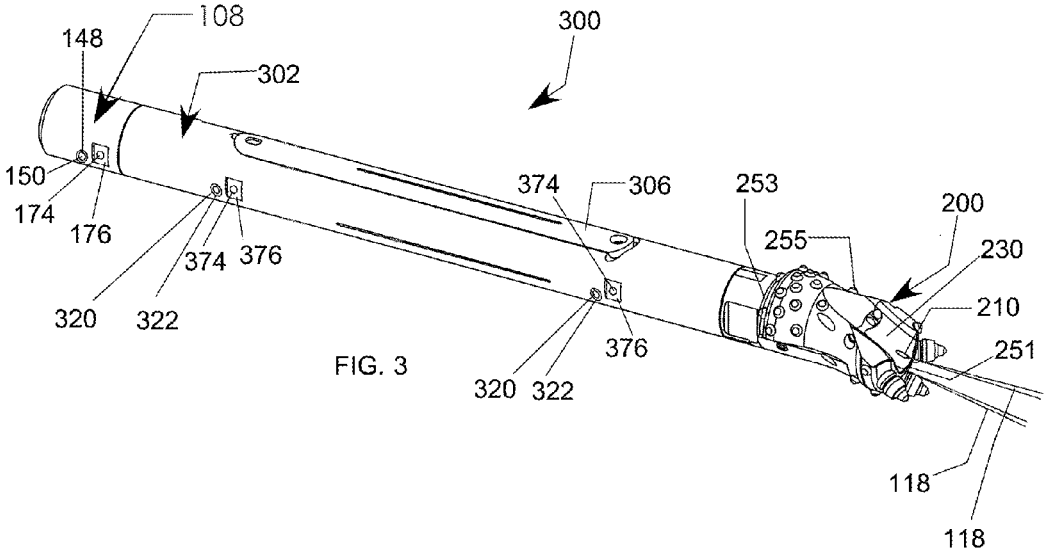
FIG. 3 is an isometric view of an embodiment of a drill head assembly for HDD drilling, configured for pilot boring with an offset rock bit.

Reference will now be made in detail to the present preferred embodiments of the invention, examples of which are illustrated in the accompanying drawings.

Generally, what is disclosed is an improved drill head assembly for horizontal directional drilling that improves performance and capability during direct pullback operations. FIG. 1 shows one embodiment of a drill head assembly 100 for HDD drilling, and more specifically, for pilot boring operations using an HDD rig and drill rods. The drill head assembly 100 includes an elongated housing 102. The housing 102 is shown as being generally cylindrical, but may be of any other suitable shape. The housing 102 has a front portion or front 103 and a rear portion or rear 105, and a length therebetween. A longitudinal axis passes through the front and rear 103, 105 of the housing 102, along the length. An exemplary longitudinal axis may coincide with the horizontal portion of the line 2-2 of FIG. 1.

A "sonde" electronic transmitter 112 is mounted to the housing 102 and located in an interior 101 of the housing 102. The sonde transmitter 112 is equipped with electronics (e.g., radio frequency transmitter) that permit the location of the sonde transmitter 112 to be identified while the transmitter 112 is underground. In the illustrated form, the transmitter 112 is retained in the interior 101 of the housing 102 by a lid 106. The lid 106 may be retained in a closed position, for example, by one or more bolts 141 and may be removed from the closed position shown in FIG. 2, where the lid 106 retains the transmitter 112 in the housing 102 and restricts access to the transmitter 112, such that access to the transmitter 112 is permitted, for example, for maintenance, removal, or other operations. The lid 106 and sonde 112 in FIG. 2 are conventional and any suitable sonde or lid may be used with the housing 102. For proper operation of the transmitter 112, it is preferable that the transmitter 112 is kept at temperatures not exceeding 100° C.

An optional rear adapter 108 may be removably (e.g., threadably) attached at the rear 105 of the housing 102, as shown in FIG. 1. The rear adapter 108 may be used to permit a drill rod (or other tools) to be coupled (e.g., via threads or an interference fit) to the housing 102. The drill rods (not shown) are preferably added by an operator at the HDD rig to a drill string, one at a time (e.g., end-to-end via a threaded connection), during pilot bore drilling operation, to incrementally extend the length of the pilot bore made by the drill head assembly 100. It will be appreciated that a drill rod alternatively may be coupled (e.g., via a threaded connection) to the rear of the housing 102 directly, without the use of the optional rear adapter 108. The drill rods are preferably coupled to a fluid source, such that when a drill rod in a series of interconnected drill rods is coupled to the housing 102 of the drill head assembly 100 (with or without the use of the optional rear adapter 108), the drill rod provides fluid to be pumped through the housing 102 to assist in wetting and softening the ground around the drill head assembly 100.

Figure 12:
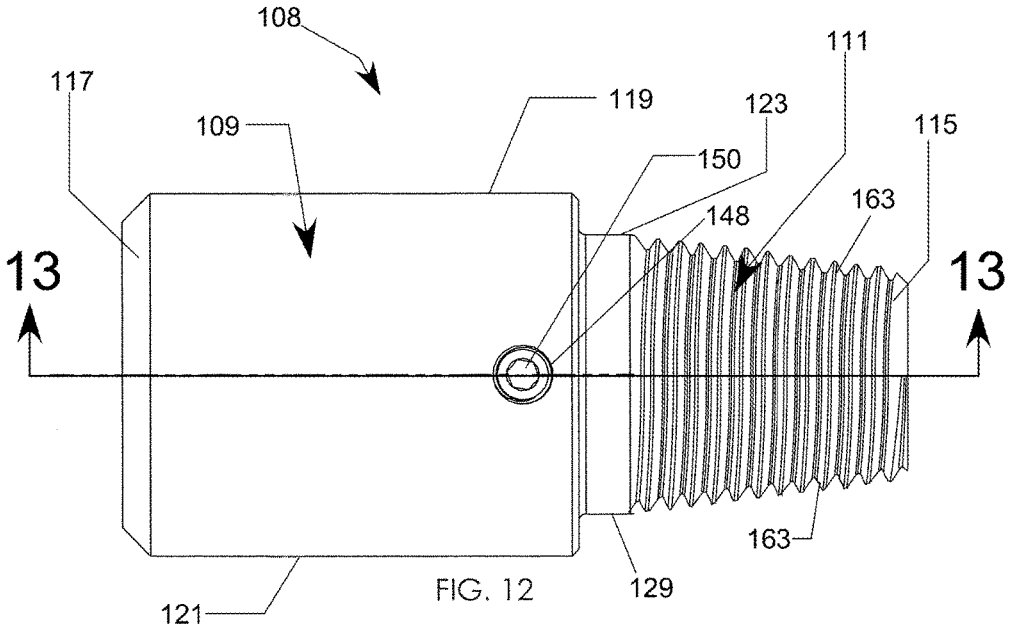
FIG. 12 is a top plan view of an embodiment of the optional rear adapter configured for coupling to a housing of a drill head assembly.
Figure 13:
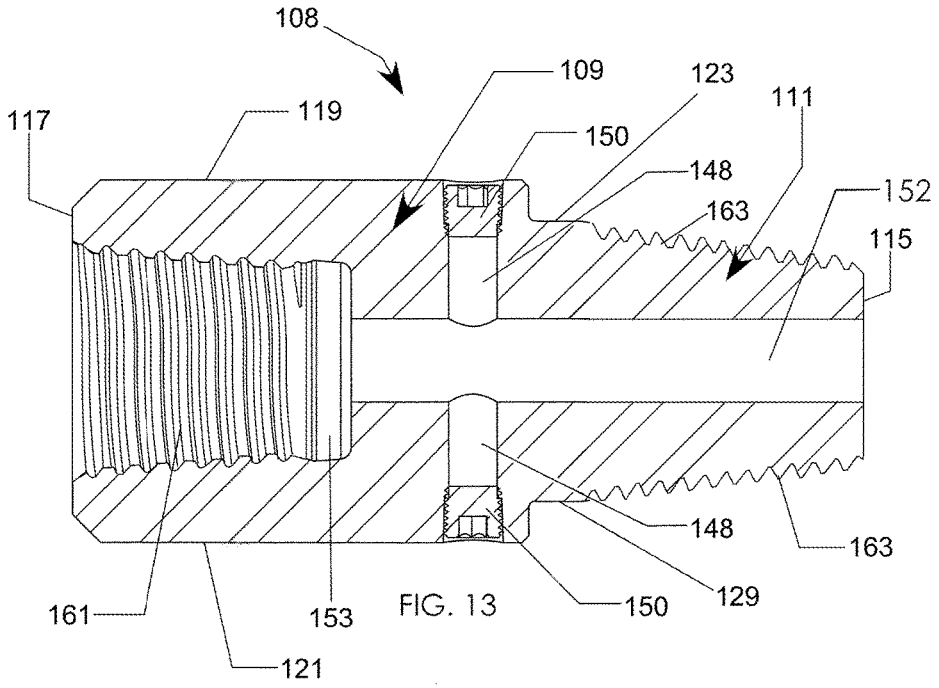
FIG. 13 is a side elevational section view of the optional rear adapter of FIG. 12, taken along line 13-13 of FIG. 12.

The optional rear adapter 108 is shown in more detail in FIGS. 12 and 13. With reference to FIG. 12, the exemplary optional rear adapter 108 has a front end 115, a rear end 117, a length therebetween, and a longitudinal axis passing through the front and rear ends 115, 117. An exemplary longitudinal axis may coincide with the horizontal portion of the line 13-13 of FIG. 12. The rear adapter 108 includes a rear portion 109 with a top surface 119 and a bottom surface 121 and a front portion 111 with a top surface 123 and a bottom surface 129. In the embodiment illustrated in FIGS. 12-13, the top and bottom surfaces 123, 129 of the front portion 111 of the rear adapter 108 include threads 163 adapted to threadably attach the optional rear adapter 108 to the housing 102 of the drill head assembly 100. In the illustrated embodiment, the top and bottom surfaces 119, 121 of the rear portion 109 of the optional rear adapter 108 are straight and parallel to each other, while the top and bottom surfaces 123, 129 of the front portion 111 are straight and converge toward each other in a direction front the rear end 117 to the front end 115 of the rear adapter 108. It will be appreciated that the top and bottom surfaces 119, 121, 123, 129 of the front and rear portions 109, 111 may have various shapes (at least in part curved, zigzagged, undulating, etc.) and orientations relative to each other and may be non-parallel, diverging, parallel, or converging relative to one another.

In the illustrated form, the rear 105 of the housing 102 has an open area or recess 107 for receiving a portion of the rear adapter 108, more specifically, the front portion 111 of the rear adapter 108. As discussed above, preferably, the rear adapter 108 includes threads 163 at top and bottom surfaces 123 and 129 and the rear 105 of the housing 102 includes threads 173 corresponding to the threads of the rear adapter 108 such that the rear adapter 108 and the rear 105 of the housing 102 can be threadably coupled such that at least a portion of the rear adapter 108 is received in the recess 107 at the rear 105 of the housing 102, as shown in FIG. 2. While the rear adapter 108 is coupled to the rear of the housing 102 via a threaded connection in the illustrated form, it will be appreciated that any suitable connection other than a threaded connection may be used, for example, a spline and pin, an interference fit, or a friction fit, or one or more fasteners. It is to be appreciated that instead of being removably attached to the housing 102, the optional rear adapter 108 may be formed a part of the structure of the housing 102 such that the rear adapter 108 and the housing 102 form a unitary monolithic structure.

The housing 102 includes a main fluid passage or channel 114 and a fluid outlet 116 that is in communication with the channel 114. It will be appreciated that instead of having a single channel 114, the housing 102 may optionally include two or more such channels. The channel 114 extends in a direction along the longitudinal axis of the housing 102 along a majority of the length of the housing 102 as shown in FIG. 2, and may pass through the entire length of the housing 102. The channel 114 may extend such that the recess 107 at the rear 105 of the housing 102 is in fluid communication with the fluid outlet 116 via the channel 114, as shown in FIG. 2. The fluid outlet 116 is located at the front 103 of the housing 102 and is adapted to permit a fluid (e.g., water or bentonite slurry) that flows through the channel 114 to be emitted from the front 103 of the housing 102 through the fluid outlet 116. In one form, the fluid outlet 116 includes one or more openings, and is preferably in the form of a nozzle adapted to permit the fluid to be emitted from the front 103 of the housing 102 in one or more jets to wet and soften up the soil in front and around the front 103 of the housing 102 of the drill head assembly 100. As shown, for example, in FIG. 2, the nozzle 116 is oriented in a direction along the longitudinal axis.

With reference to FIGS. 1, 2, and 4-7, the housing 102 may include one or more openings defining auxiliary fluid ports 122 in communication with the main fluid passage or channel 114. As such, a fluid flowing under pressure through the channel 114 in a direction from the rear 105 to the front 103 of the housing 102 would exit through the fluid ports 122, if the fluid ports 122 are open. In the illustrated embodiment, the fluid ports 122 are oriented in a direction transverse both to the channel 114 and the longitudinal axis of the housing 102. It is to be appreciated, however, the angle of the fluid ports 122 relative to the channel 114 is shown by way of example only, and that the fluid ports 122 may be oriented at a variety of orientations not transverse to the channel 114. For example only, the fluid ports 112 may be oriented at 15°, 30°, 45°, 60°, 75°, 120°, 135°, 150°, 165°, or an other suitable orientation relative to the channel 114. The fluid ports 122 may be located at various locations of the housing 102. For example, one or more fluid ports 122 may be positioned at or proximate the front 103 of the housing 102 and one or more fluid ports 122 may be positioned at or proximate the rear 105 of the housing 102, as shown by way of example in FIGS. 1-2 and 6-7. It will be appreciated that the auxiliary fluid ports 122 can be located in components of the drill assembly 100 other than, or in addition to, the housing 102. For example, as discussed in more detail below, the optional rear adapter 108 is shown in FIGS. 1-2, 4-7, and 13 as having an optional fluid port 148 which, if open (i.e., not sealed by a plug 150), would permit fluid to exit therethrough. Further, while not shown in FIGS. 1 and 2, FIG. 3 shows that the optional rear adapter 108 may optionally include one or more flat portions 176 each including an opening 174 similar to the flat portion 176 and openings 174 in the housing 102 to permit a cutting block 170 to be optionally attached to the optional rear adapter 108 via a fastener passing through the opening 174.

In one embodiment, one or more plugs 120 are inserted into the fluid ports 122 to seal the fluid ports 122. Similarly, if the optional rear adapter 108 is used, the fluid port 148 of the rear adapter 108 may be sealed by a plug 150. In one form, the plugs 120 include threads and are threaded into the fluid ports 122, which include corresponding threads to permit a threaded coupling of the plugs 120 to the ports 122. The attachment of the plugs 120 to the ports 122 to partially and/or fully obstruct and partially and/or fully seal the ports 122 may be used in pilot boring operation. For example, during pilot boring operation, a high pressure drilling fluid is pumped through the channel 114 of the housing 102. Since the fluid ports 122 are blocked by the plugs 120, the fluid is prevented from being emitted through the ports 122. Instead, the fluid flowing through the channel 114 is ejected in one or more high pressure jets 118 through the nozzle 116 located at the front 103 of the housing 102. The fluid jets 118 facilitate the steering of the drill head assembly 100 through the pilot bore and the cutting of the soil ahead of a paddle bit 104 attached to the housing 102, which will be described in more detail below.

Figure 19:
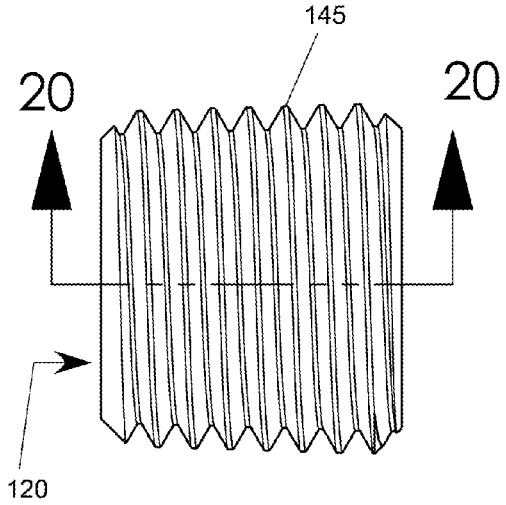
FIG. 19 is a side elevational view of one embodiment of a plug for insertion into a fluid port in a housing of a drill head assembly.
Figure 20:
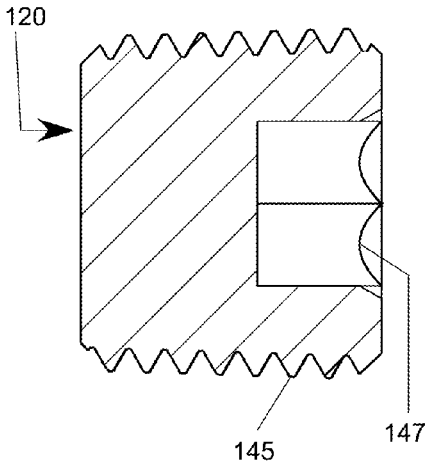
FIG. 20 is a side elevational sectional view of the plug of FIG. 19 taken along line 20-20.
Figure 21:
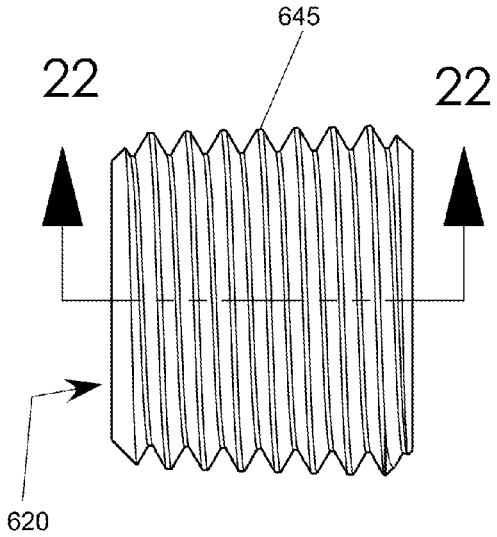
FIG. 21 is a side elevational view of another embodiment of a plug for insertion into a fluid port in a housing of a drill head assembly.
Figure 22:
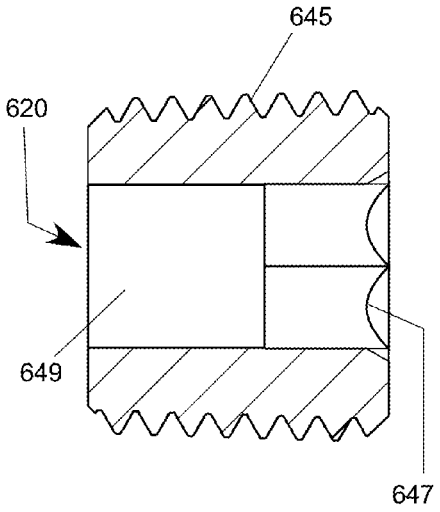
FIG. 22 is a side elevational sectional view of the plug of FIG. 21 taken along line 22-22.

One exemplary plug 120 that includes exterior threads 145 and an interior recess including edges 147 shaped to mate with an end of a tool (e.g., a hex key), and which may be used to block the fluid ports 122 of the housing 120 is shown in FIGS. 19 and 20. In one approach, during direct pullback operations, the plugs 120, which are preferably solid and do not have a through hole as shown in FIG. 20, may be replaced with pre-drilled fluid plugs 620 as shown in FIGS. 21 and 22. As shown, for example, in FIG. 22, such pre-drilled plugs 620 may also include exterior threads 645 and a recess including hex-shaped (or alternatively shaped)

interior edges 647 and may be provided with one or more through holes 649 of various sizes, to permit a drilling fluid flow rate to be adjusted to suit the needs of almost any horizontal directional drilling installation. Also, during direct pullback, one or more undrilled plugs 620 may be left in the fluid ports 122 to regulate the amount of drilling fluid flow rate and the location(s) where the drilling fluid is discharged from the housing 102. Alternatively, for direct pullback operations, the solid plugs may be removed and not replaced to permit drilling fluid to be emitted through the entire opening of the fluid ports 122.

In one optional embodiment, the rear adapter 108 includes one or more auxiliary fluid ports 148, as shown in FIGS. 2 and 13. Such fluid ports 148 in the rear adapter 108 may provide an additional benefit by allowing drilling fluid flow near the very rear of the drill head assembly 100, facilitating the direct pullback operation. As shown in FIG. 13, the fluid ports 148 of the rear adapter 108 are in fluid communication with a fluid passage or second channel 152, which in turn may be in fluid communication with the main fluid passage or first channel 114 of the housing 102 when the rear adapter 108 is coupled to the housing 102. As shown in FIG. 13, the fluid ports 148 of the rear adapter 108 may be at least partially obstructed and/or sealed by plugs 150 similar to the plugs 120 or 620 described above. At least partially obstructing and/or sealing the fluid ports 148 with the plugs 150 may be useful during pilot bore operations for the same reasons as at least partially obstructing and/or sealing the fluid ports 122 of the housing 102 with the plugs 120 is useful during pilot bore operations, as described above.

To permit a drill rod (not shown) to be coupled to the drill head assembly 100, the rear adapter 108 includes an open area or opening 153 adapted to receive and couple to a portion (e.g., an end) of the drill rod. The drill rod may be in turn connected via one or more additional interconnected drill rods that may be attached end-to-end and/or positioned over a drill string to a water source such as a water hose. In the embodiment illustrated in FIGS. 2 and 13, the opening 153 of the rear adapter 108 includes threads 161 that permit a lead end of the drill rod to threadably couple to the rear adapter 108. Since the opening 153 is in fluid communication with the channel 152 of the rear adapter 108, a fluid flowing through the drill rod may flow through the channel 152 of the rear adapter 108 and through the channel 114 of the housing 102 towards the nozzle 116 as described above.

In one illustrated embodiment, for example, in FIGS. 1, 2, 4, and 6-8, a paddle bit 104 is attached to the housing 102 at the front 103 of the housing 102. As shown, for example, in FIGS. 2 and 8, the paddle bit 104 has a front end 151, a rear end 153 opposite the front end 151, and a plurality of teeth or projections or drill bit cutting elements 155 extending from the paddle bit 104 and adapted for cutting through soil to permit forward movement of the drill assembly 100 during pilot bore operations. At the front end 151 of the paddle bit 104, the paddle bit 104 may include a through hole or opening 110. The opening 110 permits attachment of a swivel arm assembly 124 or a pulling link (80), as described below. At the rear end 153, the paddle bit 104 may include an opening 113 that may, in one embodiment, permit access to a bolt 141 that retains the lid 106 in the closed position. In embodiment illustrated in FIGS. 1-2, the paddle bit 104 is attached directly to housing 102 at the front 103 of the housing 102, via fasteners 143 (six fasteners 143 are shown by way of example only, but the number of fasteners may vary) such as bolts or pins. The paddle bit 104 does not have to be attached directly to the housing 102 and may be attached via an intermediate connector or drill bit adapter assembly 154, as shown in FIG. 14-16 and described below.

Figure 14:
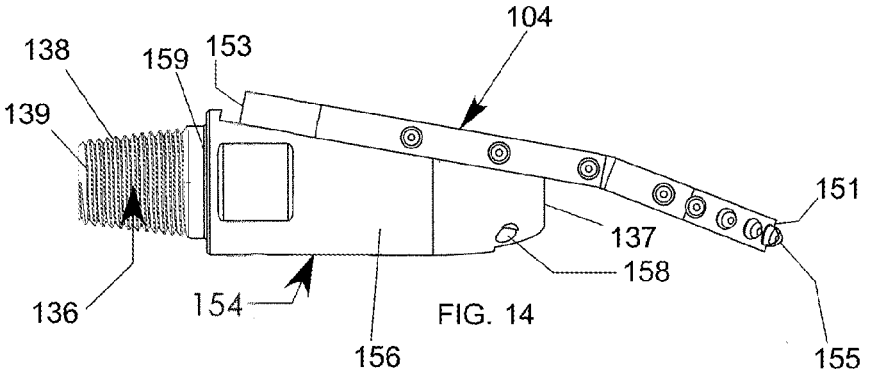
FIG. 14 is a side elevational view of a drill bit body and paddle bit according to one embodiment.
Figure 15:
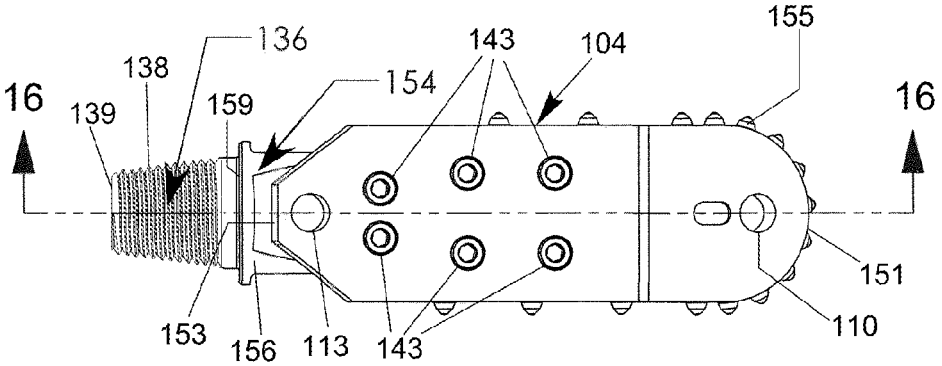
FIG. 15 is a top plan view of the drill bit body and paddle bit of FIG. 14.
Figure 16:
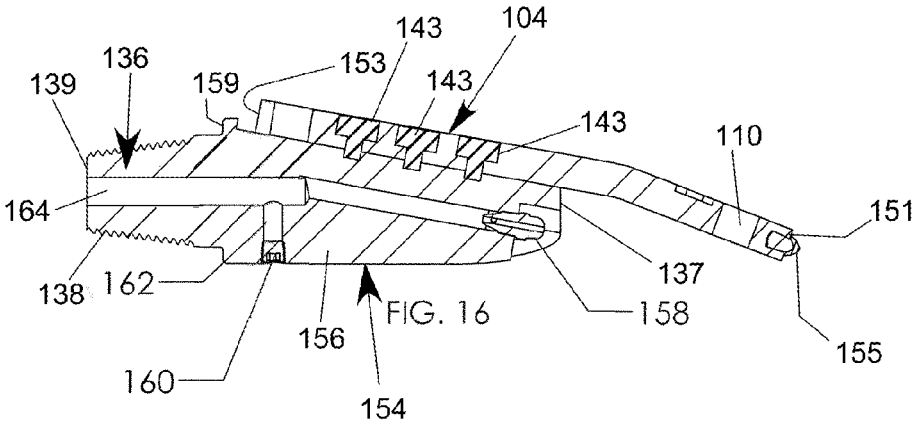
FIG. 16 is a side elevational section view of the drill bit body and paddle bit of FIGS. 14-15, taken along line 16-16 of FIG. 15.
Figure 17:
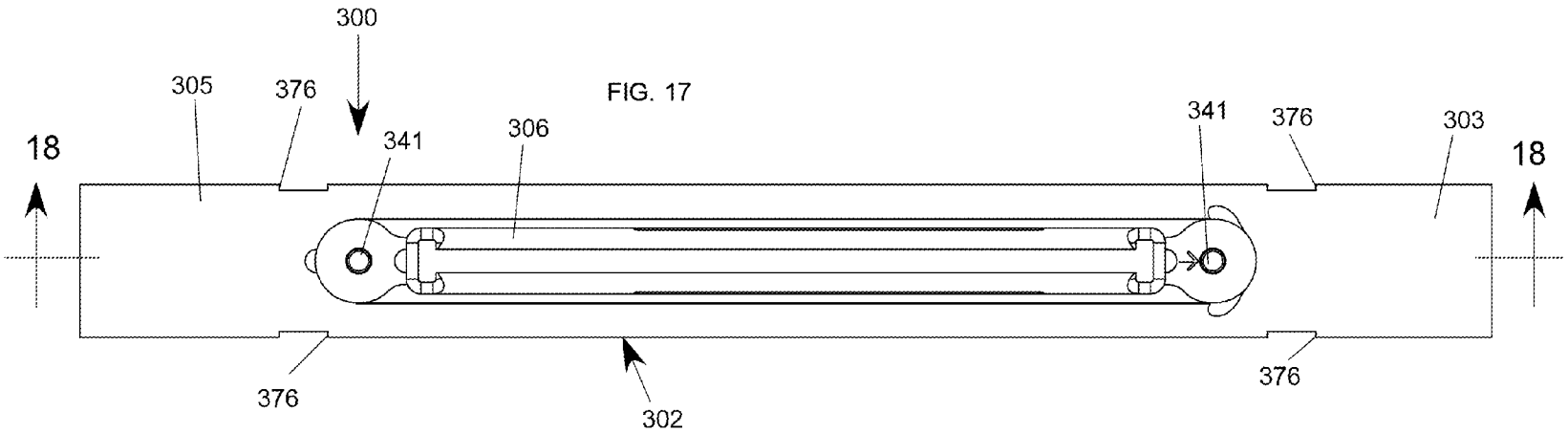
FIG. 17 is a top plan view of one embodiment of the housing of the drill head assembly of FIG. 8.
Figure 18:
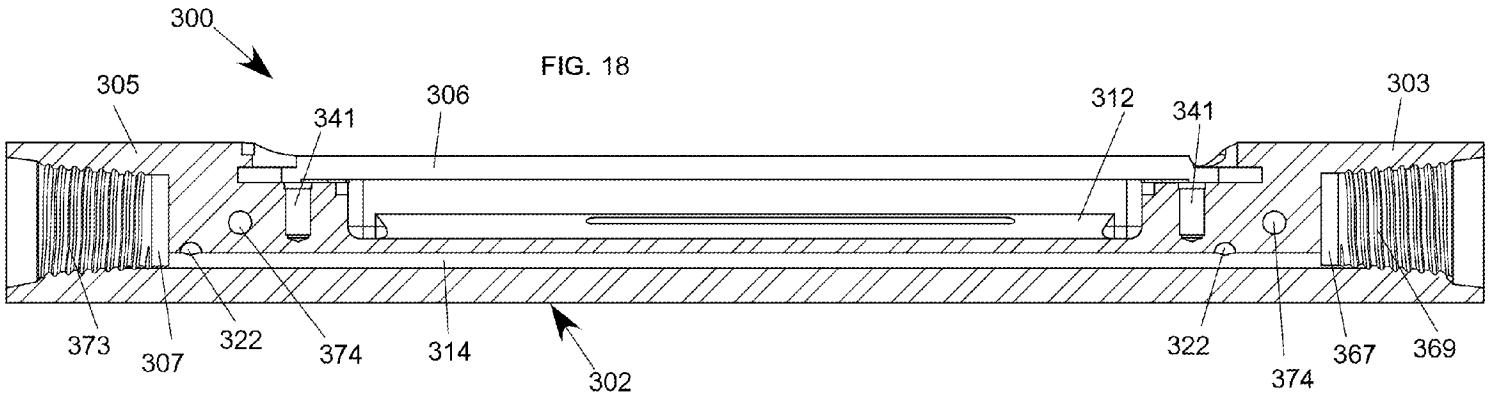
FIG. 18 is a side elevational sectional view of the housing of FIG. 17 taken along line 18-18.

FIGS. 14-16 illustrate an exemplary embodiment of a drill bit adapter assembly 154 that may be used to permit attachment of the paddle bit 104 to a housing 302 of the drill head assembly 300 as shown in FIGS. 17-18. The housing 302 of the drill head assembly 300 is similar to the housing 302 of the drill head assembly 100 and is labeled with like reference numerals, but unlike the housing 102, which has a front end 103 that lacks a threaded recess area adapted to receive a threaded adapter portion 136 of a drill bit adapter assembly 154, the front end 303 of the housing 302 of the drill head assembly 300 includes an open or recess area 367 that includes threads 369 as shown in FIG. 18 that permit the threaded adapter portion 136 of the adapter assembly 154 to be threadably and removably secured to the front end 303 of the housing 302. The bit adapter assembly 154 includes a bit adapter or bit body 156, which is preferably cylindrical, but which may be of any other suitable shape, as shown in FIG. 16.

A drill bit 104 may be removably or non-removably coupled to the bit body 156 of the bit adapter assembly 154. For example, the drill bit 104 may be mounted on top of the bit body 156 and secured via fasteners 143 (six fasteners 143 are shown by way of example only, but the number of fasteners may vary), as shown, for example, in FIG. 16. Alternatively, the drill bit 104 may be optionally made as a monolithic unitary structure with the bit body 156.

The bit body 156 further includes an adapter portion 136 at a rear 139 of the bit body 156. The adapter portion 136 may be integrally formed as a part of a unitary monolithic structure with the bit body 156, or may be non-removably, or removably attached (e.g., via a threaded connection) to the bit body 156. The adapter portion 136 is sized and shaped (e.g., frusto-conical) to be inserted into, and mate with a complementary-shaped (e.g., frusto-conical) recess area 367 at the front 303 of the housing 302 of the drill head assembly 300. For example, the adapter portion 136 preferably includes threads 138, but may be attached via one or more fasteners (e.g., bolts, pins, or the like) to the front 303 of the housing 302.

At a front 137 of the bit body 156, the bit body 156 has a fluid passage or channel 164 and a fluid outlet 158 in communication with the channel 164. The channel 164 extends in a direction along the longitudinal axis of the bit body 156 and may pass through the entire length of the bit body 156. The opening or fluid outlet 158 may be in the form of a nozzle that permits a fluid to exit the fluid outlet 158 in the form of a jet, for example, during pilot bore drilling operations. The exemplary bit body 156 of FIG. 16 may optionally also include one or more auxiliary fluid ports 162 in communication with the channel 164 and fluid plugs 160 similar to the plugs 120, 150, or 620 described above for at least partially obstructing and/or sealing the fluid ports 162, which may be removed when appropriate, for example, during direct pullback operations.

FIG. 3 illustrates one embodiment of a drill head assembly 300 in a form configured for pilot boring operation. The drill head assembly 300 includes a housing 302 and, instead of a paddle bit 104 as described above, includes an offset rock bit 200 attached to the housing 302. The offset rock bit 200 is preferably attached to the housing 302 by being threaded directly into the threads 369 of the recess area 367 (see, e.g., FIG. 18) at the front 303 of the housing 302. More specifically, the exemplary rock bit 200 includes an adapter portion 236 including threads 238 that permit the threaded adapter portion 236 of the offset rock bit 200 to be threadably and removably secured to the front end 303 of the housing 302. It will be appreciated that instead of being threaded into the housing 302 of the drill head assembly 300, the offset rock bit 200 may be optionally modified for attachment to a housing such as the housing 102 via one or more fasteners such as bolts. As shown in FIGS. 3 and 17-18, similar to the housing 102, the housing 302 includes one or more openings defining auxiliary fluid ports 322 in communication with a main fluid passage or channel 314 passing through the interior of the housing 302. As such, as described above, a fluid flowing under pressure through the channel 314 passing through the interior of the housing 302 would exit through the fluid ports 322, if the fluid ports 322 are open and not obstructed or sealed by removable plugs 320, which may be similar to plugs 120 or 620 described above.

With reference to FIG. 3, the offset rock bit 200 has a front end 251, a rear end 253 opposite the front end 251, and a plurality of teeth or projections 255 extending from the offset rock bit 200 and adapted for cutting through soil to permit forward movement of the drill assembly 300 during pilot bore operations. At the front end 251 of the offset rock bit 200, the offset rock bit 200 may include one or more openings or fluid ports 210. During pilot bore drilling operations, high pressure drilling fluid is ejected through the fluid ports 210 in high pressure jets 118 from the front end 251 of the offset rock bit 200, softening the soil around the offset rock bit 200 to facilitate the pilot boring operations.

Upon completion of the pilot bore, the drill head assemblies 100, 300 may be reconfigured for direct pullback operations. In one embodiment shown in FIG. 4, a swivel connector or connecting member 124 is attached to the paddle bit 104. The connecting member 124 has a front end 131 including an aperture 139 that permits attachment of a tow head or duct puller 126 configured to retain and pull a conduit 127 (e.g., pipe, cable, or the like) during direct pullback operations. The connecting member 124 has a rear end 133 including an aperture 137 that permits the rear end 133 of the connecting member 124 to be securely fastened (directly or indirectly, as described below) to the paddle bit 104.

Figure 4:
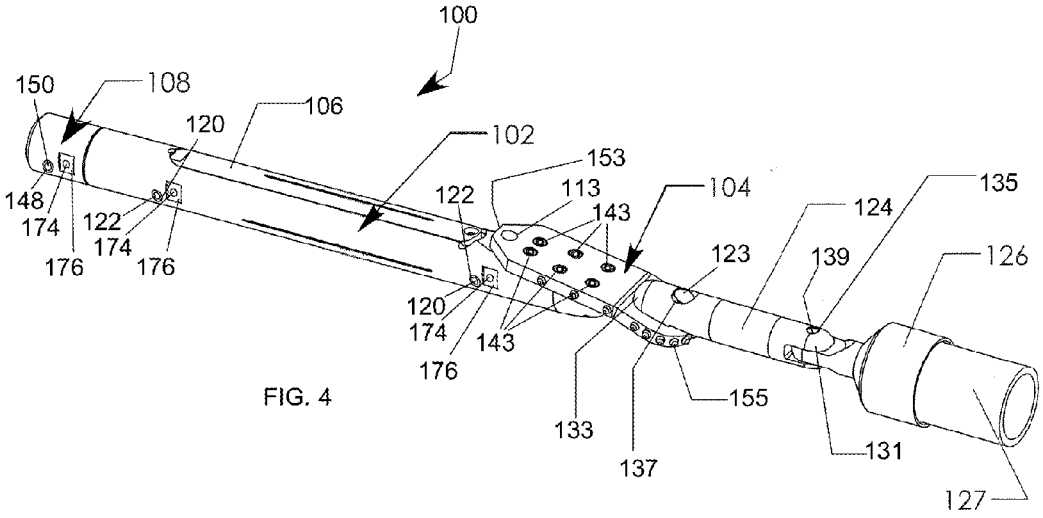
FIG. 4 is an isometric view of the drill head assembly for HDD drilling of FIG. 1, including attachments configured for direct pullback operations.
Figure 6:
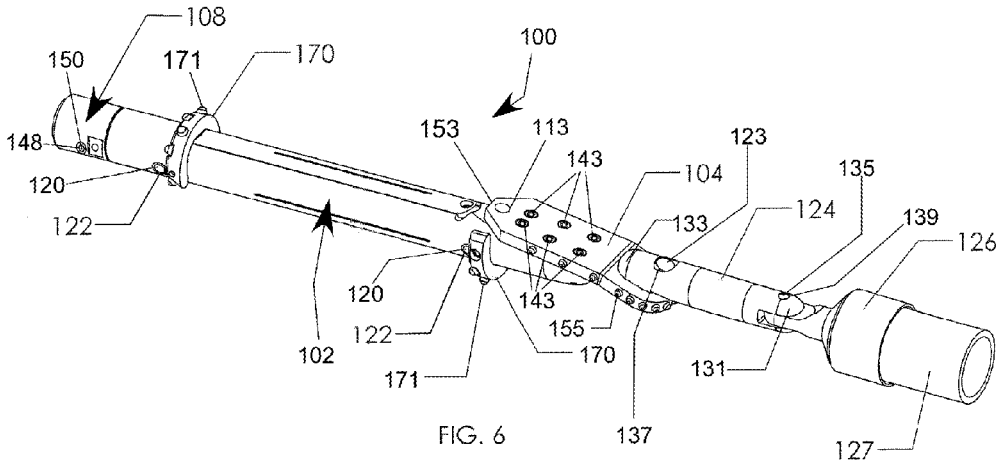
FIG. 6 is an isometric view of the drill head assembly for HDD drilling of FIG. 4, including cutting block attachments coupled to a housing of the drill head assembly.
Figure 7:
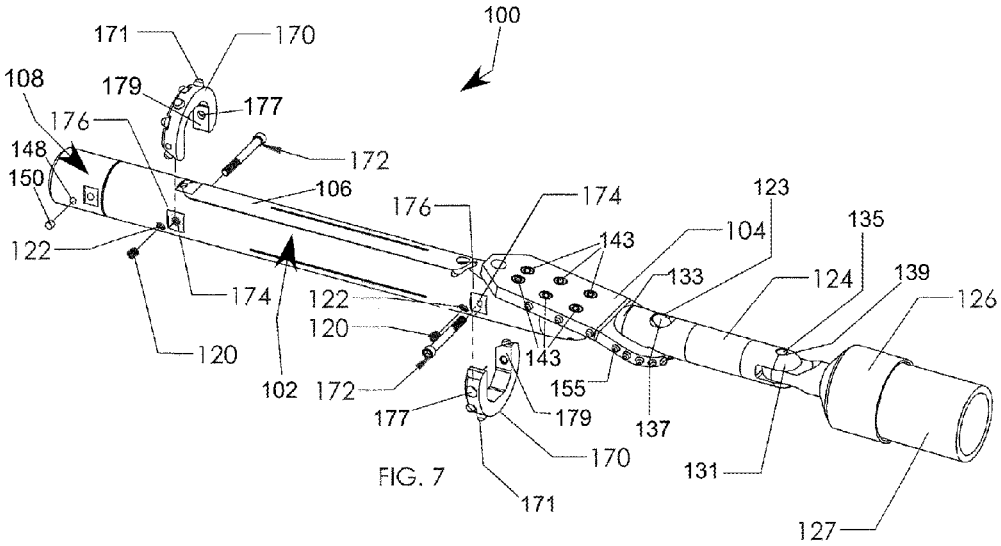
FIG. 7 is the same view as in FIG. 6, including partially exploded views to show how the cutting block attachments couple to the housing of the drill head assembly of FIG. 6.

For example, in the form illustrated in FIG. 4, the rear end 131 of the swivel connector 124 may be securely fastened directly to the front end 151 of the paddle bit 104 via an attachment member 123. The attachment member 123 may be a bolt or pin that passes through the opening 110 in the paddle bit 104 and through the opening 137 in the swivel connector 124, as shown in FIGS. 4, 6, and 7. The bolt, pin, or other fastener 123 may be secured by a nut 157 or the like on an opposite side of the paddle bit 104. The connecting member 124 is thus securely (e.g., rigidly, or non-movably) attached to the to the paddle bit 104 via the fastener 123. Preferably, the swivel connector 124 is securely attached to the paddle bit 104 such that a longitudinal axis of the swivel connector 124 is generally aligned with the longitudinal (e.g., central) axis of the housing 302, which restricts the swivel connector 124 from flopping over or jack knifing.

Figure 11:
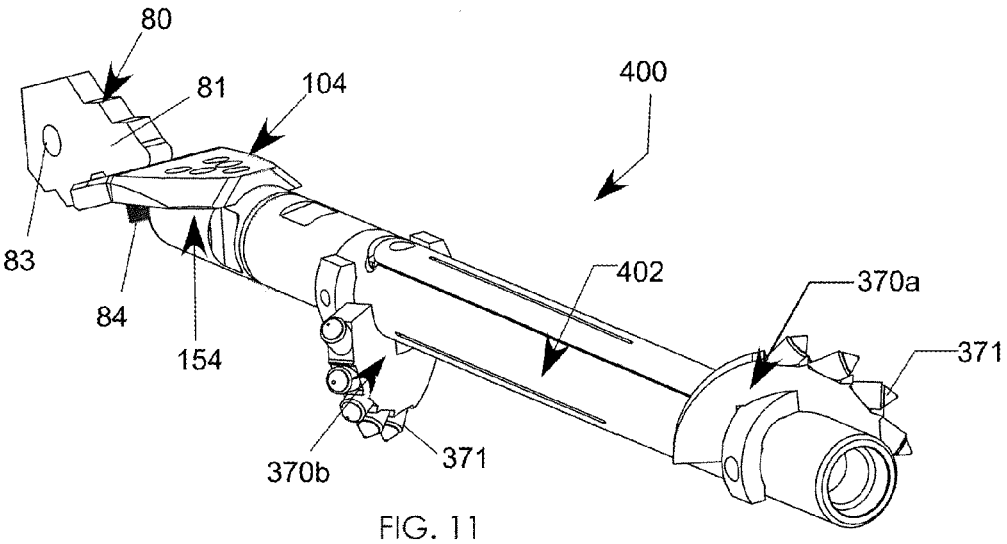
FIG. 11 is a perspective view of an embodiment of a drill head assembly including a paddle bit coupled to a connecting link and incorporating two cutting blocks as shown in FIG. 10.
Figure 23:
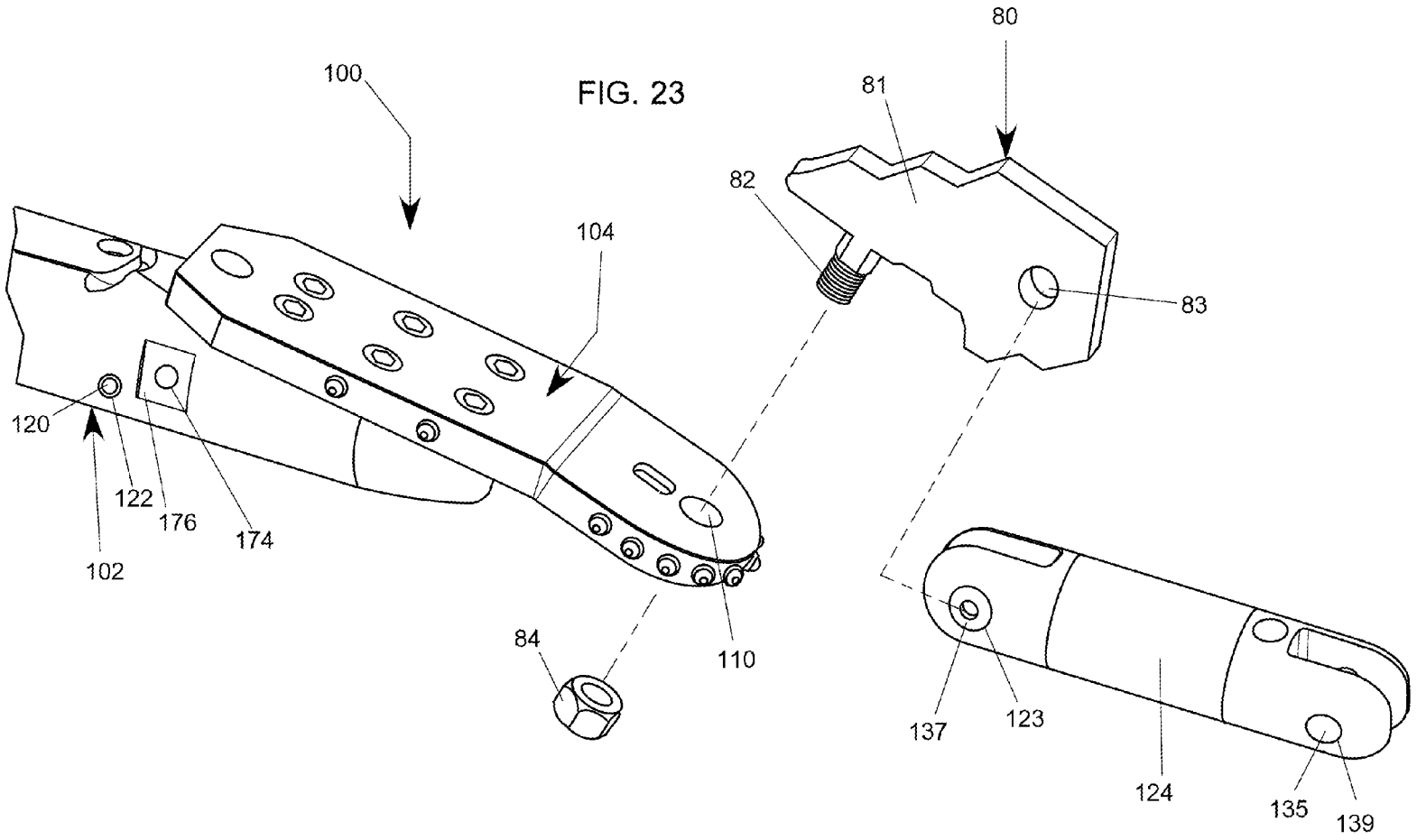
FIG. 23 is an enlarged partial view of a front end of the drill head assembly of FIG. 1 , showing an exploded view of a connecting link connectable to the drill bit and a swivel connector connectable to the connecting link.

Alternatively to connecting the swivel connector 124 directly to the paddle bit 104, a connecting link 80 may be used to indirectly attach the swivel connector 124 to the paddle bit 104.For example, FIG. 23 shows an embodiment where a connecting link 80 is used to attach the swivel connector 124 to the paddle bit 104. The exemplary connecting link 80 includes a body 81, a threaded attachment member 82 extending downwardly from the body 81, and an opening 83 passing through the body 81. FIG. 11 shows an embodiment of an exemplary drill head assembly 400 including a housing 402 and a paddle bit 104 attached to the housing 402 via a threaded connection of the bit body adapter 154 and including the optional connecting link 80.

In the embodiment illustrated in FIGS. 11 and 23, the connecting link 80 is attached to the paddle bit 104 by way of the threaded attachment member 82 passing through the opening 110 in the paddle bit 104 and securely tightening a nut 84 onto the attachment member 82 such that the connecting link is securely attached to the paddle bit 104 and preferably (but not necessarily) restricted from swiveling about a central axis of the opening 110. With the connecting link 80 being securely attached to the paddle bit 104, the swivel connector 124 may be attached to the connecting link 80 by passing a fastener 123 such as a bolt or a pin through an opening 137 of the swivel connector 124 and through the opening 83 of the connecting link 80 to securely attach the swivel connector 124 to the connecting link 80 as generally shown in FIGS. 11 and 23. While the connecting link 80 has been shown with an opening 83 to permit the swivel connector 124 to attach to the connecting link 80, it will be appreciated that the connecting link 80 may include any other suitable means for connecting the swivel connector 124 to the connecting link 80, for example an elongated threaded connector. Preferably, the swivel connector 124 is securely attached to the connecting link 80 such that the longitudinal axis of the swivel connector 124 remains generally aligned with the longitudinal (e.g., central) axis of the housing 302, which restricts the swivel connector 124 from flopping over or jack knifing.

With the swivel connector 124 connected to the paddle bit 104 as shown in FIGS. 6 and 7 or to the connecting link 80 as shown in FIG. 11, a tow head or duct puller 126, which is sized and shaped (e.g., cylindrical) to retain an end of a conduit 127 during direct pullback operations, may be attached to the swivel connector 124 via a fastener 135, as shown in FIGS. 4 and 6. The fastener 135 may be a bolt or pin that passes through the opening 139 in the connecting member 124 and through a corresponding opening in the tow head 126, as shown in FIGS. 6-7. Alternatively, a connecting link or shackle may be used to attach the tow head 126 to the swivel connector 124. In the form illustrated in FIGS. 6 and 7, the conduit 127 being retained by the tow head 126 during direct pullback operations is in the form of a pipe, but it is to be appreciated that the tow head 126 may be sized and shaped to receive and retain a cable, or any other conduit that is suitable for underground installation.

For direct pullback operations, one or more fluid plugs 120, 320 may be removed from the auxiliary fluid ports 122, 322 in the housing 102, 302 of the drill head assembly 100, 300. Similarly, if the optional rear adapter 108 is used, one or more plugs 150 may be removed from the fluid port 148 of the rear adapter 108. In the preferred embodiment, the auxiliary fluid ports 122, 322 in the housings 102, 302 (and the optional auxiliary port 148 in the rear adapter 108) have a larger diameter than the opening in the fluid outlet 116 (or the fluid port 158 of the bit body adapter 154, or the fluid port 210 of the rock bi adapter 200). As such, a during the direct pullback operations, when a pressurized fluid (e.g., via a drill rod coupled to the optional rear adapter 108) is introduced into the housing 102, a majority of the drilling fluid flowing through the channel 114 of the housing 102 flows out of the housing 102 through the auxiliary fluid ports 122. Thus, the flow of the fluid from the fluid ports 122 during the direct pullback operations occurs at a higher flow rate and lower pressure than the fluid flow (jets 118) through the nozzle 116 during the pilot boring operation described above. The drilling fluid flow through the fluid ports 122 of the housing 102 advantageously improves pullback operations by lubricating the soil in and around the hole in the area of the housing 102. The increased drilling fluid flow rate in the area of the housing 102 also advantageously facilitates the cooling of the electronic transmitter 112. In addition, the larger diameter of the fluid ports 122 may advantageously reduce the chance that the fluid ports 122 become clogged by sand or other particles than is the nozzle 116.

In the embodiment illustrated in FIG. 7, cutting blocks 170 are mounted to the housing 102. The cutting blocks 170 may have projections, teeth, or cutting block cutting elements 171, for example, carbide cutting elements, or hard surfacing, and enlarge the hole being drilled to a size larger than the pilot bore hole to provide an enlarged hole suitable for the diameter of the conduit (e.g., pipe, cable, etc.) 127 being installed in the hole.

In one preferred form, the housing 102 includes one or more flat portions 176 each including an opening 174 (which may or may not be threaded), and the cutting blocks 170 are shaped such that they include corresponding flat portions 179 and openings 177. Thus, the cutting blocks 170 may be positioned such that each cutting block 170 at least in part surrounds the housing 102 and the flat portions 179 of the cutting block are aligned with the flat portions 176 of the housing 102, and the openings 177 of the cutting block are aligned with the openings 174 of the housing 102 to permit a fastener 172 such as a screw or a bolt to pass through the openings 176, 177 to securely attach the cutting blocks 170 to the housing 102. Optionally, as shown in FIGS. 6-7, the rear adapter 108 may also include one or more flat portions 176 each including an opening 174 similar to the flat portions 176 and openings 174 of the housing 102 to permit an additional cutting block 170 having corresponding flat portions 179 and openings 177 to be positioned at least in part around the rear adapter 108 and securely attached to the rear adapter 108 via one or more bolts 172.

The flat portions 176 of the housing 102 and the flat portions 179 of the cutting blocks 170 advantageously retain the cutting blocks 170 in the intended place and restrict the cutting blocks 170 from inadvertently rotating relative to the housing 102 or disengaging from the housing 102. While the cutting blocks 170 and the cutting elements 171 have been shown as being identical in FIGS. 6 and 7, it is to be appreciated that any of the drill assemblies 100, 300, 400 illustrated herein may include cutting blocks 170 of different sizes, or identical cutting blocks 170 having cutting elements 171 of varying sizes, such that a first cutting block would make a hole having a first diameter as it passes through the soil, and a second cutting block 170 would make a hole having a second, greater, diameter as it passes through.

Further, while the cutting blocks 170 have been shown in FIGS. 6-7 as being attached to the housing 102 of the drill assembly 100, it will be appreciated that one or more cutting blocks 170 may be attached to the housing 302 of the drill assembly 300. In particular, as shown in FIGS. 5 and 8, the housing 302, similarly to the housing 102, also includes one or more flat portions 376 each including an opening 374 to permit one or more correspondingly sized and shaped cutting blocks 170 to be attached to the housing 302 via one or more fasteners.

Figure 5:
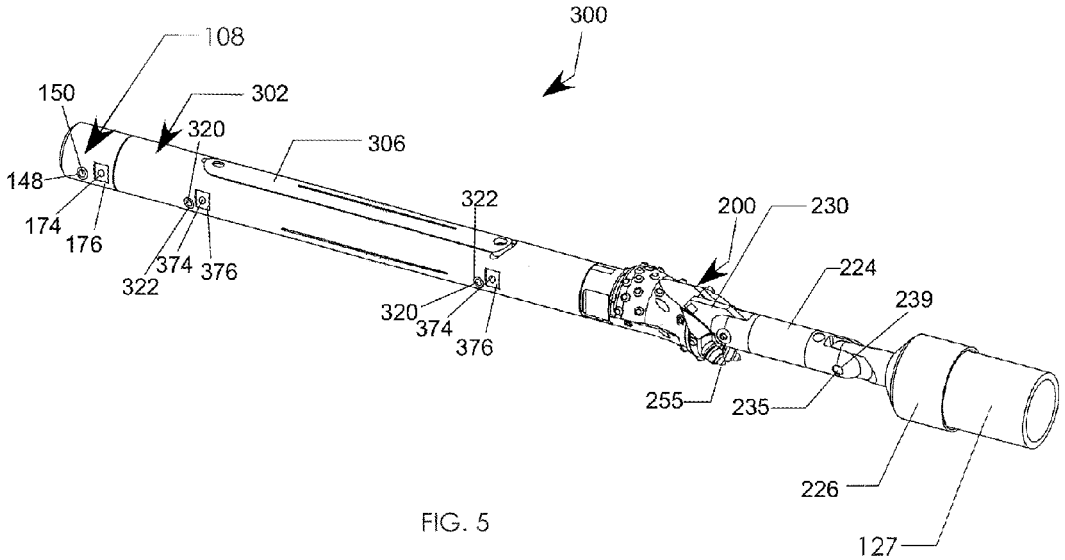
FIG. 5 is an isometric view of a drill head assembly for HDD drilling of FIG. 3, including attachments configured for direct pullback operations.

FIG. 5 shows an embodiment of the drill head assembly 300 as configured for direct pullback operation. In particular, in the exemplary illustrated form configured for direct pullback operation, the offset rock bit 200 of the drill head assembly 300 is coupled to a swivel connector 224 via, for example, a connecting link 230 as shown in FIG. 5. The connecting link 230 may be integral to, and form a unitary structure, with the offset rock bit 200, or may be attached to the offset rock bit 200 via one or more fasteners such as bolts. It will be appreciated that the swivel connector or connecting member 224 may be directly coupled to the offset rock bit 200 instead of being coupled to the rock bit 200 via the connecting link 230. In the embodiment shown in FIG. 5, the swivel connector 224 is attached via a swivel connection to a tow head or duct puller 226, which in turn retains a conduit 127 such as a pipe in a substantially similar way as described above in reference to the swivel connector 124, tow head 126, and conduit 127 of FIG. 4.

Figure 8:
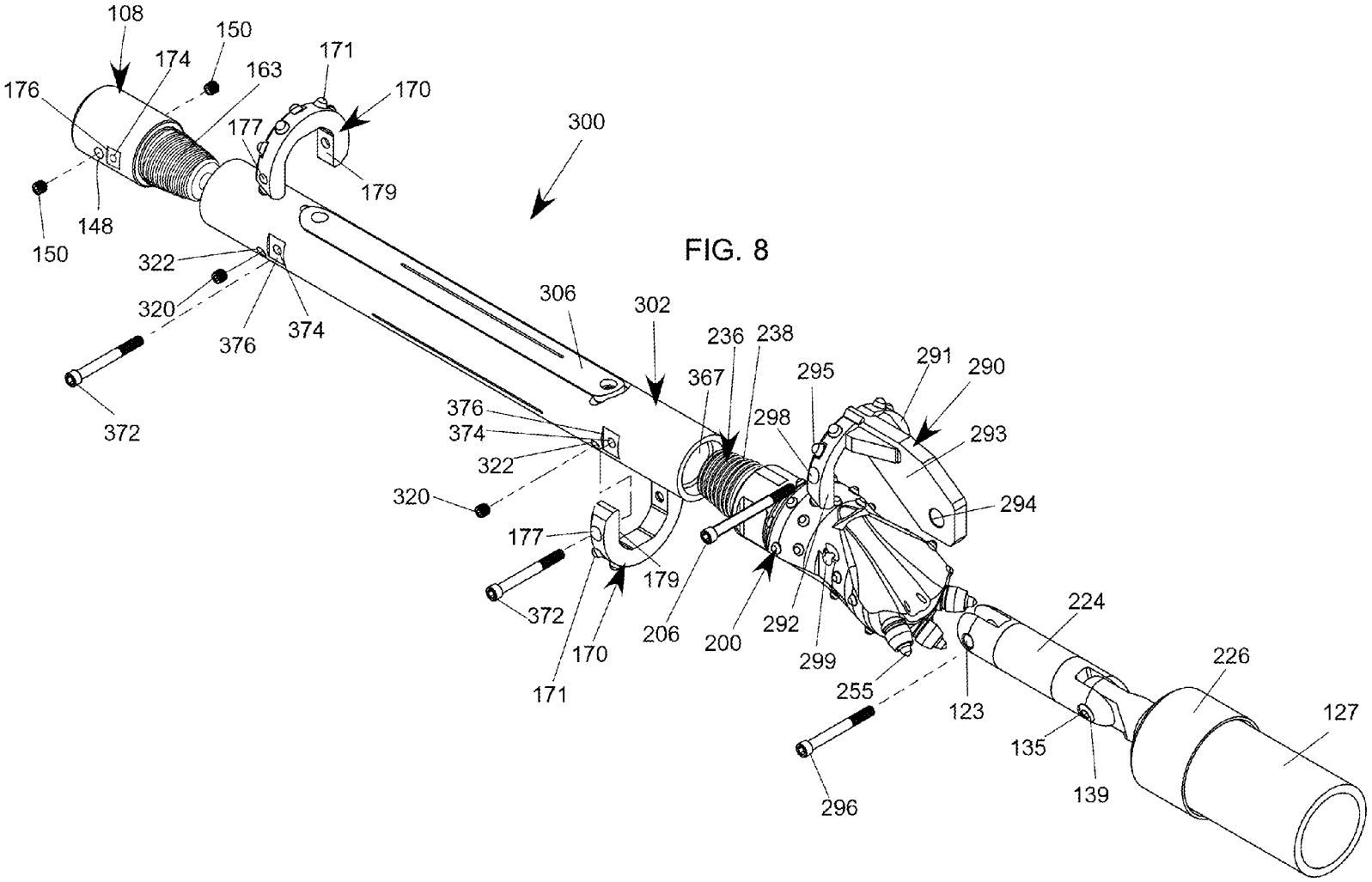
FIG. 8 is an isometric view of an embodiment of a drill head assembly for pullback operations with an offset rock bit including partially exploded cutting blocks, pullback adapter, and rear adapter.

In one preferred embodiment shown in FIG. 8, the offset rock bit 200, instead of including a connecting link 230, is coupled to an exemplary embodiment of a pullback adapter 290. In the illustrated exemplary form, the pullback adapter 290 is securely attached to the rock bit 200 and coupled to a swivel connector 224, which is securely attached to the pullback adapter 290 and is in turn swivelably coupled to the tow head 226. In the exemplary embodiment shown in FIG. 9, the offset rock bit 200 includes one or more auxiliary fluid ports 202, which may be open during direct pullback operations and at least partially obstructed and/or sealed via removable plugs 214 (which include threads 244 for threadable coupling with the fluid ports 202) during pilot bore drilling operations. The attachment of the pullback adapter 290 to the offset rock bit 200 is illustrated in more detail in FIG. 9.

Figure 9:
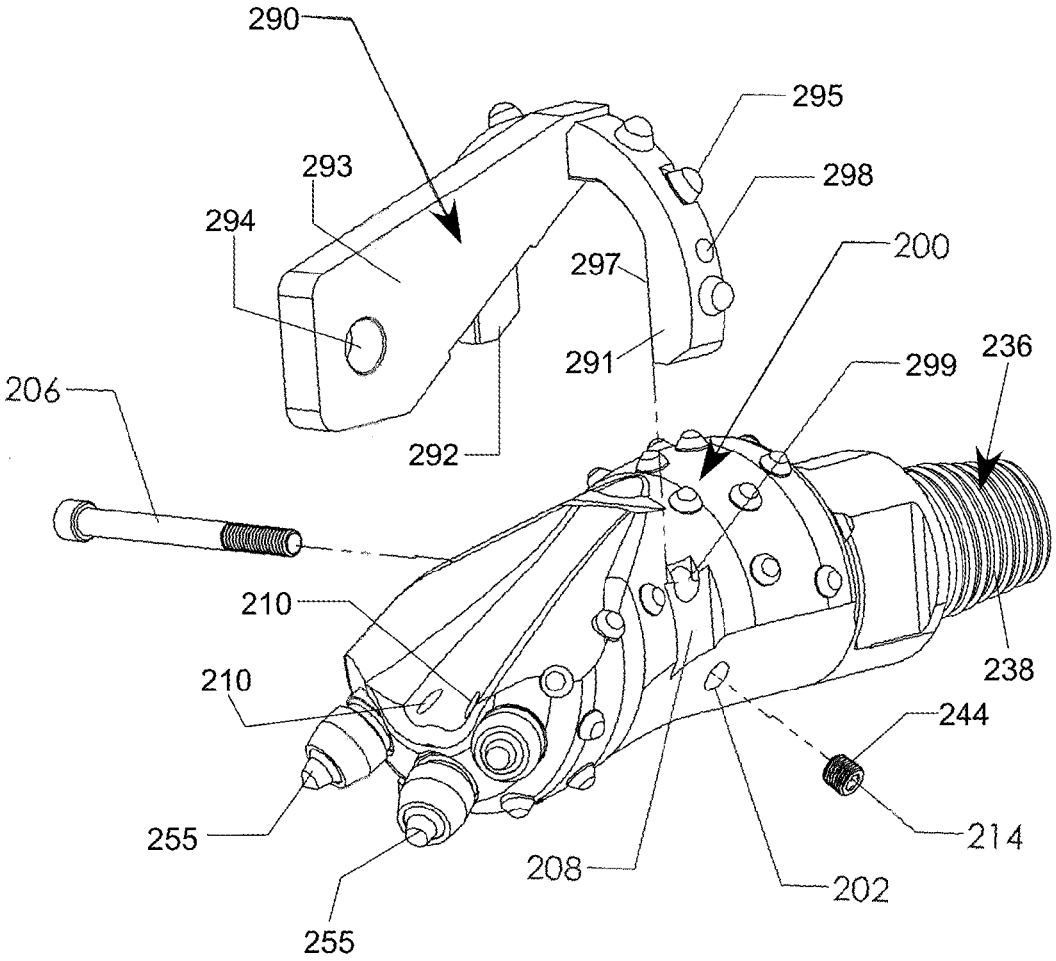
FIG. 9 is an enlarged perspective view of the offset rock bit of FIG. 8, with a partial exploded view to show the coupling of the pullback adapter to the offset rock bit.

With reference to FIG. 9, the exemplary pullback adapter 290 includes a first arm 291 and a second arm 292 and a link plate 293. In one form, the arms 291, 292 and the link plate 293 may form a monolithic structure wherein the arms 291 and 292 are non-detachably attached (e.g., by welding) to the link plate 293. The arms 291, 292 each include one or more teeth, barbs, or cutting elements 295, preferably, carbide cutting elements and are shaped and configured to serve a function similar to the cutting blocks 170 described above. The link plate 293 is shown as separating the first and second arms 291, 292 by way of example only, and it will be appreciated that the first and second arms 291, 292 may form an integral structure or may be attached directly to each other. The link plate 293 includes an opening 294. The opening 294 permits a swivel connector 224 as described above to be securely attached to the link plate 293 of the pullback adapter 290, for example by a fastener 296 (see FIG. 8), such as a bolt or a pin passing through the opening 294 and through the corresponding opening 123 in the swivel connector 224. While the pullback adapter has been shown with an opening 294 to permit the swivel connector 224 to attach to the pullback adapter 290, it will be appreciated that the pullback adapter may include any other suitable means for connecting the swivel connector 224 to the pullback adapter 290, for example an elongated threaded connector. The swivel connector 224 may then be attached via a swivel connection provided by a fastener 235 to a tow head 226, which in turn may be coupled to a conduit 127 such as a pipe or a cable in a substantially similar way as described above in reference to the swivel connector 124, tow head 126, and conduit 127 of FIG. 4. The fastener 235 may be a bolt or pin that passes through the opening 239 in the swivel connector 224 and through a corresponding opening in the tow head 226, as shown in FIGS. 5 and 8.

In the exemplary form illustrated in FIG. 9, the first and second arms 291, 292 of the pullback adapter 290 each include an internal flat surface 297 and a hole 298 for permitting a fastener 206 (see FIGS. 8-9) to pass therethrough. As shown in FIG. 9, the pullback adapter 290 is positioned such that the pullback adapter 290 at least in part surrounds the offset rock bit 200 and the flat surfaces 297 of the pullback adapter 290 are aligned with the flat portions 208 of the offset rock bit 200. The openings 298 of the pullback adapter 290 are aligned with the openings 299 of the offset rock bit 200 to permit a fastener 206 such as a screw or a bolt to pass through the openings 298, 299 to securely attach the pullback adapter 290 to the offset rock bit 200. The flat portions 208 of the offset rock bit 200 and the flat surfaces 297 of the pullback adapter 290 advantageously retain the pullback adapter 290 and restrict the pullback adapter 290 from inadvertently rotating relative to the offset rock bit 200 or disengaging from the offset rock bit 200.

Figure 10:
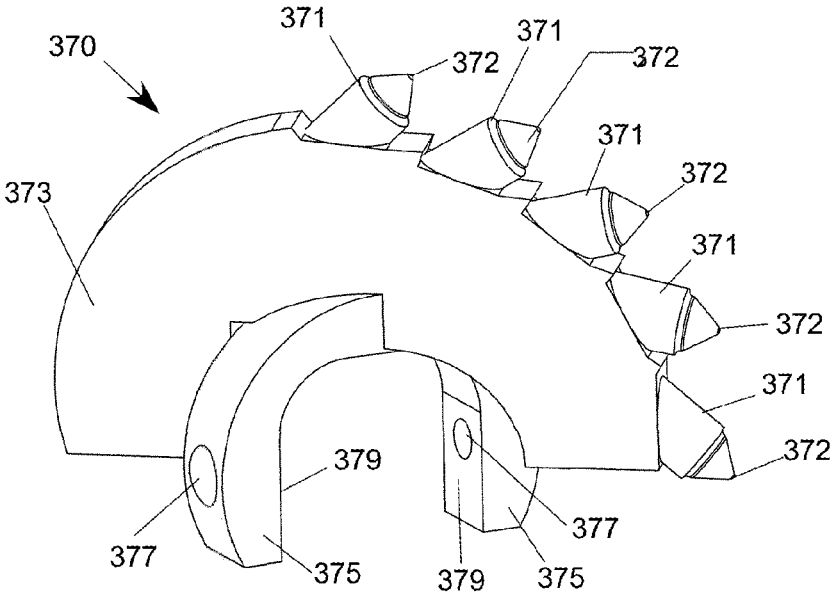
FIG. 10 is an enlarged perspective view of a cutting block according to an alternative embodiment.

FIG. 10 is an alternative embodiment of a cutting block 370. The exemplary cutting block 370 includes a body 373, multiple cutting elements 371, preferably carbide cutting elements, attached to and extending from the body 373, and first and second arms 375 attached to and extending from the body 373. In the illustrated form, the cutting elements 371 are welded to the body 373 of the cutting block 370, but the cutting elements 371 may be attached to the body 373 of the cutting block 370 by any other suitable means, for example, by being screwed in or attached via fasteners. Similarly, the arms 371, 372 may be integrally formed with the body 373 (e.g., by welding) or may be attached to the body 373 by a fastener. In the embodiment illustrated in FIG. 10, the arms 375 include opposed interior flat portions 379 adapted to permit the first and second arms 375 of the cutting block 370 to slide over corresponding flat portions 376 of the housing 302 of the drill head assembly 300. One or both of the arms 375 may include an opening 377 to permit the cutting block 370 to be attached by a fastener to the housing 302 of the drill head assembly 300 or a housing of a different drill head assembly, for example, the housing 402 of the drill head assembly 400 as shown in FIG. 11.

In the illustrated exemplary form, the cutting elements 371 of the cutting block 370 are sized, shaped, and positioned such that the cutting elements 371 incrementally increase the size of the underground hole being drilled. For example, the cutting elements 371 may or may not be identical in size and the apexes 372 of the cutting elements 371 may point in different directions and may lie on curved lines having incrementally increasing radii. It will be appreciated that the cutting elements 371 are sized and oriented as shown in FIG. 10 by way of example only and various configurations of the cutting elements may be used to accommodate for different soil conditions and to cut varying hole diameters to accommodate varying conduit diameters. For example, FIG. 11 shows an embodiment of an exemplary drill head assembly 400 including a housing 402 with a first cutter block 370*a*, the cutting elements 371 of which will enlarge the hole to a first diameter, and a second cutter block 370*b*, the cutting elements 371 of which will enlarge the hole to a second diameter greater than the first diameter. Such an enlargement of the diameter of the pilot bore during pullback operations advantageously facilitates the passing of the tow head 126 and the conduit 127 through the bore.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

What is claimed is:

1. A cutting block for attachment to a horizontal drilling apparatus, the cutting block comprising:

a body including at least one cutting element extending therefrom, the at least one cutting element being adapted to cut through soil; and first and second arms extending from the body, the first and second arms having an opening therebetween configured to permit a portion of the horizontal drilling apparatus to pass therethrough, the first and second arms including opposed portions adapted to permit the first and second arms of the cutting block to slide over corresponding portions of the horizontal drilling apparatus such that the portion of the horizontal drilling apparatus passes through the opening between the first and second arms of the cutting block and the first and second arms of the cutting block at least in part surround the portion of the horizontal drilling apparatus; and at least one of the first and second arms including at least one fastener-receiving hole passing therethrough and adapted to permit a fastener to pass therethrough to attach the at least one of the first and second arms of the cutting block to the horizontal drilling apparatus.

2. The cutting block of claim 1, wherein the at least one cutting element includes a plurality of cutting elements that are incrementally increased in size.

3. The cutting block of claim 1, wherein the at least one cutting element is configured to enlarge a hole being drilled by the horizontal drilling apparatus.

4. The cutting block of claim 3, wherein the hole enlargement is to a size larger than a pilot bore hole.

5. The cutting block of claim 1, wherein the portion of the horizontal drilling apparatus is a portion of a housing of the horizontal drilling apparatus.

6. The cutting block of claim 1, wherein the portion of the horizontal drilling apparatus is a portion of a drill bit of the horizontal drilling apparatus.

7. The cutting block of claim 6, wherein the drill bit is an offset drill bit.

8. The cutting block of claim 7, the cutting block further comprising a tab coupled to the body of the cutting block, the tab configured to allow the cutting block to be used as a pullback adapter when the cutting block is mounted to the horizontal drilling apparatus.

9. An apparatus for horizontal directional drilling, comprising:

an elongated housing including an interior, a front, a rear, a longitudinal axis passing through the front and rear, and at least one opening for receiving a cutting block fastener;

a sonde transmitter mounted in the interior;

a main fluid channel to permit a flow of a fluid therethrough, the channel extending in the interior of the housing in a direction along the longitudinal axis;

a fluid outlet at the front of the housing, the fluid outlet being in fluid communication with the channel and adapted to permit the fluid to flow therethrough such that the fluid is emitted from the front of the housing;

a plurality of fluid ports in fluid communication with the main fluid channel and adapted to permit the fluid to be emitted from the housing through the fluid ports, at least one of the fluid ports being at least in part obstructed by a removable fluid plug, whereby the apparatus is configured to adjust flow rate and flow locations to provide suitable lubrication to the housing during drilling operations;

a drill bit coupled to the front of the housing, the drill bit including a plurality of drill bit cutting elements;

a connecting member indirectly coupled to the drill bit via one of a connecting link and a pullback adapter such that the connecting member is securely attached to the drill bit with a central longitudinal axis of the connecting member being generally aligned with a central longitudinal axis of the housing;

a tow head coupled to the connecting member such that the tow head is permitted to swivel relative to the connecting member, the tow head being sized and shaped to receive a portion of a conduit and retain the portion of the conduit during a direct pullback operation of the apparatus; and at least one cutting block mounted to a portion of the horizontal drilling apparatus, the cutting block comprising a body including at least one cutting element extending therefrom, the at least one cutting element being adapted to cut through soil, and first and second arms extending from the body and having an opening therebetween, whereby the first and second arms of the cutting block at least in part surround the portion of the horizontal drilling apparatus.

10. The apparatus for horizontal drilling of claim 9, wherein the portion of the horizontal drilling apparatus is a portion of the housing.

11. The apparatus for horizontal drilling of claim 10, further including at least a first cutting block removably coupled to the housing and including first cutting block cutting elements defining a first outer diameter extending therefrom, and at least a second cutting block removably coupled to the housing and including second cutting block cutting elements defining a second outer diameter extending therefrom, the second outer diameter being greater than the first outer diameter.

12. The apparatus for horizontal drilling of claim 9, wherein the portion of the horizontal drilling apparatus is one of a portion of the drill bit of the horizontal drilling apparatus.

13. The apparatus for horizontal drilling of claim 12, wherein the drill bit is an offset drill bit.

14. The apparatus for horizontal drilling of claim 13, further comprising a tab coupled to the body of the cutting block, the tab configured to allow the cutting block to be used as a pullback adapter.

15. The apparatus for horizontal drilling of claim 9, wherein the at least one cutting element of the cutting block includes a plurality of cutting elements that are incrementally increased in size.

16. The apparatus for horizontal drilling of claim 9, wherein the at least one cutting element of the cutting block is configured to enlarge a hole being drilled by the horizontal drilling apparatus.

17. The apparatus for horizontal drilling of claim 16, wherein the hole enlargement is to a size larger than the pilot bore hole.

18. The apparatus for horizontal drilling of claim 9, further comprising a rear adapter coupled to the rear of the housing, the rear adapter configured to permit a fluid source to be coupled to the housing, the rear adapter including a fluid passage extending in a direction along the longitudinal axis and in communication with the main fluid channel in the housing.

19. The apparatus for horizontal drilling of claim 18, wherein the portion of the horizontal drilling apparatus is a portion of the rear adapter.

20. The apparatus for horizontal drilling of claim 9, wherein the mounting of the cutting block includes holes in the portion of the horizontal drilling apparatus and at least one of the first and second arms including at least one fastener-receiving hole passing therethrough and adapted to permit a fastener to pass therethrough to attach the at least one of the first and second arms of the cutting block to the portion of the horizontal drilling apparatus.

* * * * *